US009002239B2

(12) United States Patent
Kawarazuka

(10) Patent No.: US 9,002,239 B2
(45) Date of Patent: Apr. 7, 2015

(54) IMAGE FORMING APPARATUS PROVIDING A CONTROLLED DELIVER OF DEVELOPER AFTER STARTUP

(71) Applicant: Fuji Xerox Co., Ltd., Minato-ku, Tokyo (JP)

(72) Inventor: Hiroshi Kawarazuka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 96 days.

(21) Appl. No.: 13/743,085

(22) Filed: Jan. 16, 2013

(65) Prior Publication Data

US 2013/0279942 A1 Oct. 24, 2013

(30) Foreign Application Priority Data

Apr. 24, 2012 (JP) ..... 2012-099062

(51) Int. Cl.
*G03G 15/08* (2006.01)

(52) U.S. Cl.
CPC ..... *G03G 15/0865* (2013.01); *G03G 15/0877* (2013.01)

(58) Field of Classification Search
USPC ..... 399/27, 61, 118, 258, 260, 262
See application file for complete search history.

(56) References Cited

U.S. PATENT DOCUMENTS 7,620,334 B2 * 11/2009 Shimizu ..... 399/30
2006/0051136 A1 3/2006 Tsuda et al.

FOREIGN PATENT DOCUMENTS

JP 2000-098727 A 4/2000
JP 2004-341221 A 12/2004
JP 2006-145879 A 6/2006

* cited by examiner

*Primary Examiner* — Hoang Ngo
(74) *Attorney, Agent, or Firm* — Sughrue Mion, PLLC

(57) ABSTRACT

An image forming apparatus includes an image bearing member that bears an electrostatic latent image; a developer container containing developer; a developing unit that develops the electrostatic latent image on the image bearing member with the developer; a tubular transport-path forming member that forms a transport path through which the developer is transported from the developer container to the developing unit; a transport member that is disposed inside the transport-path forming member and transports the developer from the developer container to the developing unit; and a control unit that performs control such that, when the transport-path forming member is used for the first time or when the developer container is replaced, an operation to fill the developer into the transport-path forming member is performed by driving the transport member after the image forming operation is started.

7 Claims, 10 Drawing Sheets

IMAGE FORMING APPARATUS PROVIDING A CONTROLLED DELIVER OF DEVELOPER AFTER STARTUP

CROSS-REFERENCE TO RELATED APPLICATIONS

This application is based on and claims priority under 35 USC 119 from Japanese Patent Application No. 2012-099062 filed Apr. 24, 2012.

BACKGROUND (i) Technical Field

The present invention relates to an image forming apparatus.

(ii) Related Art

Known image forming apparatuses have a developer supply device that supplies developer from a developer container containing developer to a developing device.

SUMMARY

According to an aspect of the invention, there is provided an image forming apparatus including an image bearing member that bears an electrostatic latent image; a developer container containing developer; a developing unit that develops the electrostatic latent image on the image bearing member with the developer; a tubular transport-path forming member that forms a transport path through which the developer is transported from the developer container to the developing unit; a transport member that is disposed inside the transport-path forming member and transports the developer from the developer container to the developing unit; and a control unit that performs control such that, when the transport-path forming member is used for the first time or when the developer container is replaced, an operation to fill the developer into the transport-path forming member is performed by driving the transport member after the image forming operation is started.

BRIEF DESCRIPTION OF THE DRAWINGS

Exemplary embodiments of the present invention will be described in detail based on the following figures, wherein.

DETAILED DESCRIPTION

Exemplary embodiments of the invention will be described below with reference to the drawings.

First Exemplary Embodiment

Figure 1:
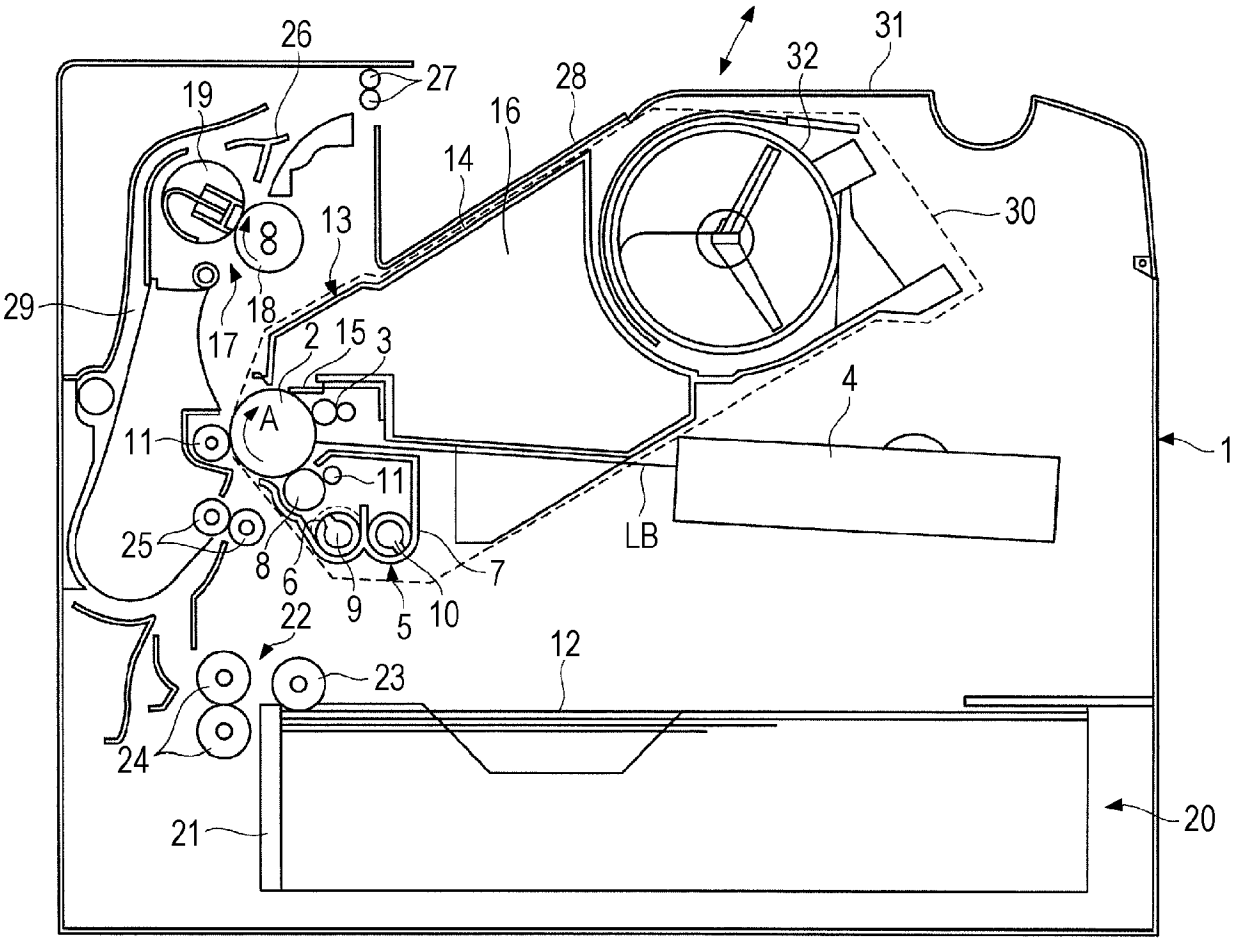
FIG. 1 is a schematic diagram showing the configuration of an image forming apparatus according to a first exemplary embodiment of the invention.

FIG. 1 is a schematic diagram showing the configuration of an image forming apparatus according to a first exemplary embodiment.

The image forming apparatus according to the first exemplary embodiment is configured as a black-and-white printer, for example. As illustrated in FIG. 1, an image forming apparatus body 1 accommodates a photoconductor drum 2 that serves as an image bearing member and is rotatable at a predetermined speed in the direction indicated by an arrow A. The photoconductor drum 2 includes a grounded hollow or solid cylindrical base member and an image bearing surface, which has a photoconductive layer (photosensitive layer) composed of a photosensitive material, formed on the periphery of the base member.

The image bearing surface of the photoconductor drum 2 is uniformly charged to a predetermined potential by a contact-type charging device 3, such as a charging roller, that is rotated while being in contact with the photoconductor drum 2. A charging voltage, i.e., a direct-current (dc) voltage or a dc voltage superimposed by an alternating-current (ac) voltage is supplied to the charging device 3.

The image bearing surface of the photoconductor drum 2 charged by the charging device 3 is irradiated with image-forming light emitted from an exposure device 4, whereby an electrostatic latent image is formed on the image bearing surface. The exposure device 4 irradiates the charged peripheral surface of the photoconductor drum 2 with laser beam LB radiated from a semiconductor laser-emitting device via a rotary polygonal minor, an f-θ lens, a reflection mirror, etc. to form an electrostatic latent image. When an electrostatic latent image is to be formed, image information (a signal) that is inputted to the image forming apparatus via an arbitrary device is transmitted to the exposure device 4. An example of the exposure device 4 is a light-emitting-diode (LED) print head that is composed of LEDs and a rod lens.

The electrostatic latent image formed on the peripheral surface of the photoconductor drum 2 is visualized into a toner image by a developing device 5. As illustrated in FIG. 1, the developing device 5 includes a housing 7 having an opening and a storage chamber in which developer 6 is stored; a developing roller 8 that holds and transports the developer 6 to a developing area where the developing roller 8 faces the photoconductor drum 2; stirring and transporting members 9 and 10, which may be two screw augers, that stir and transport the developer 6 while supplying the developer 6 to the developing roller 8; a thickness restricting member 11 that restricts the amount (thickness) of the developer 6 held by the developing roller 8; etc. A developing voltage from a power-supply device (not shown) is supplied to the developing device 5, more specifically, to the portion between the developing roller 8 and the photoconductor drum 2 of. Furthermore, the developing roller 8 and the stirring and transporting members 9 and 10 are rotated in a predetermined direction by receiving the supply of motive power from a rotary driving device (not shown). The developer 6 may be a two-component developer containing non-magnetic toner and magnetic carrier. However, the developer 6 is not limited thereto, and it may be a single-component developer composed of toner alone. The developing device 5 is filled with a predetermined amount of developer 6 at the time when the image forming apparatus is shipped.

The toner image formed on the peripheral surface of the photoconductor drum 2 is transferred onto a recording sheet 12, which serves as a recording medium, by the transfer device 11. The transfer device 11 is of a contact type and includes a transfer roller that is rotated while being in contact with the surface of the photosensitive drum 2 and is supplied with a transfer voltage. The transfer voltage is a direct-current voltage with a polarity opposite to a toner-charging polarity and is supplied from a power-supply device (not shown).

Residual toner, paper dust, etc., attached to the surface of the photoconductor drum 2 without being transferred onto the recording sheet 12 are removed by a cleaning device 13. As illustrated in FIG. 1, the cleaning device 13 includes a container-shaped body 14 having an opening, a cleaning plate 15 arranged so as to be in contact, at a predetermined pressure, with the peripheral surface of the photoconductor drum 2 after the transfer to remove the residual toner etc., and a storage portion 16 having a relatively large capacity to store the residual toner etc. cleaned by the cleaning plate 15. The cleaning plate 15 may be an elastic blade formed of, for example, rubber.

The recording sheet 12 to which the toner image has been transferred by the transfer device 11 is transported to the fixing device 17, where the toner image is fixed. The fixing device 17 includes a heating roller 18 that is rotated in the direction indicated by an arrow and is heated by a heater so that the surface temperature thereof is kept at a predetermined value, and an endless pressure belt 19 that is urged against the heating roller 18.

The recording sheet 12 is fed from a paper-feed device 20 disposed at a lower part of the image forming apparatus body 1. The paper-feed device 20 mainly includes a paper container 21 that stores a stack of recording sheets 12 of desired size and type, and a feeding device 22 that feeds the recording sheets 12 one-by-one from the paper container 21. The feeding device 22 includes, for example, a feed roller 23 that feeds the recording sheets 12 and a separation roller pair 24 that separates the recording sheets 12. The paper container 21 is attached such that it is pulled out toward the front side (a side surface to which a user faces when using the image forming apparatus; the right side in FIG. 1) of the image forming apparatus body 1 if needed.

A recording sheet 12 fed from the paper-feed device 20 is transported to the registration roller pair 25, and, at the same time when a toner image is formed on the surface of the photoconductor drum 2, the recording sheet 12 is transported by the registration roller pair 25 to a transfer position where the photoconductor drum 2 and the transfer roller 11 are in contact.

In single-side printing, the recording sheet 12 to which the toner image has been fixed by the fixing device 17 is directly outputted onto a paper-output tray 28 provided at the top of the image forming apparatus body 1 by a paper-output roller pair 27 via a switching lever 26 provided at the exit of the fixing device 17.

In double-side printing, instead of directly outputting the recording sheet 12 with an image formed on one side thereof onto the paper-output tray 28 by the paper-output roller pair 27, the paper-output roller pair 27 is reversely rotated after the trailing end of the recording sheet 12 has passed through the switching lever 26 to transport the reversed recording sheet 12 again to the registration roller pair 25 through a transport path 29 used in double-side printing, and an image is formed on the other side of the recording sheet 12.

In this exemplary embodiment, as illustrated in FIG. 1, image forming members other than the transfer device 11 and the exposure device 4, namely, the photoconductor drum 2, the charging device 3, the developing device 5, and the cleaning device 13 are configured as a single unit called a process cartridge 30. The process cartridge 30 is removably attached to the image forming apparatus body 1. The process cartridge 30 may be changed through an upper covering part 31 provided in the top of the image forming apparatus body 1 such that it is opened and closed in the direction indicated by an arrow when the photoconductor drum 2 has reached the end of its life, as illustrated in FIG. 1.

Figure 2:
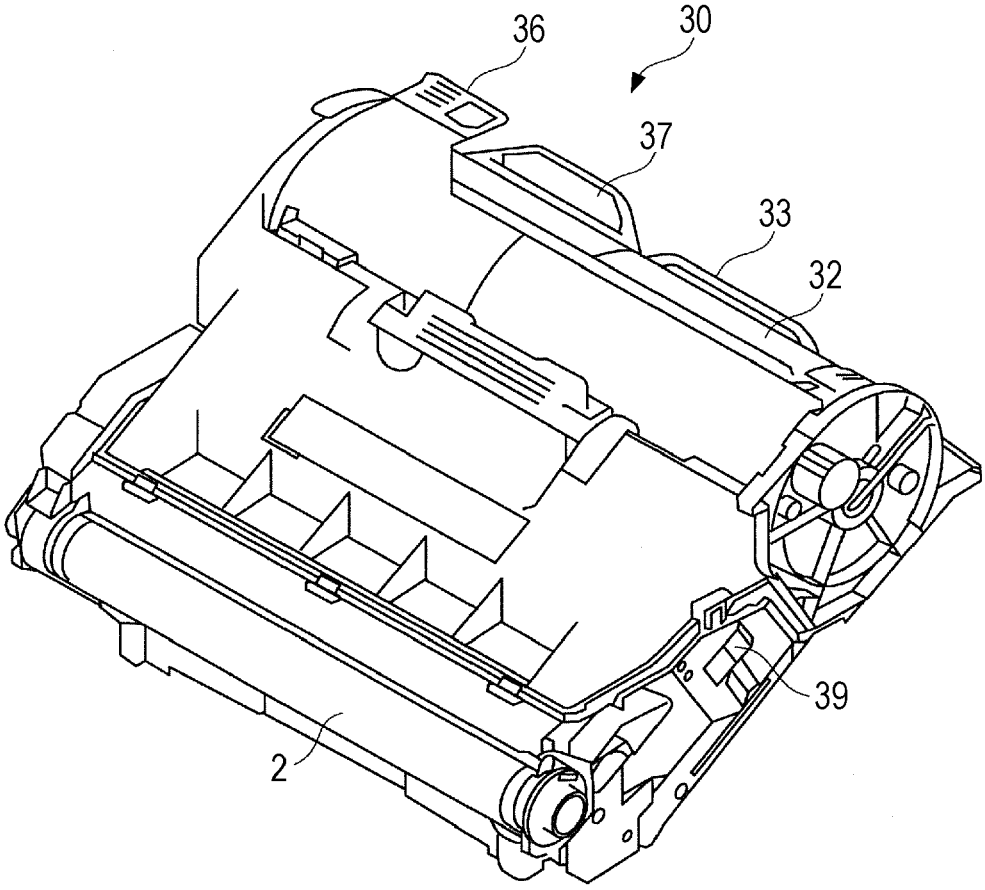
FIG. 2 is a perspective view showing the configuration of a process cartridge.

FIG. 2 is a perspective view showing the exterior of the process cartridge 30.

As illustrated in FIG. 2, a toner cartridge 32 is removably fitted to the end of the process cartridge 30 opposite to the end to which the photoconductor drum 2 is fitted. The toner cartridge 32 may be fitted to the process cartridge 30 that is either removed from the image forming apparatus body 1 or fitted to the image forming apparatus body 1. A handle 33 in FIG. 2 is a part at which a user holds the process cartridge 30 by hand when fitting the process cartridge 30 to or removing the process cartridge 30 from the image forming apparatus body 1.

Figure 3:
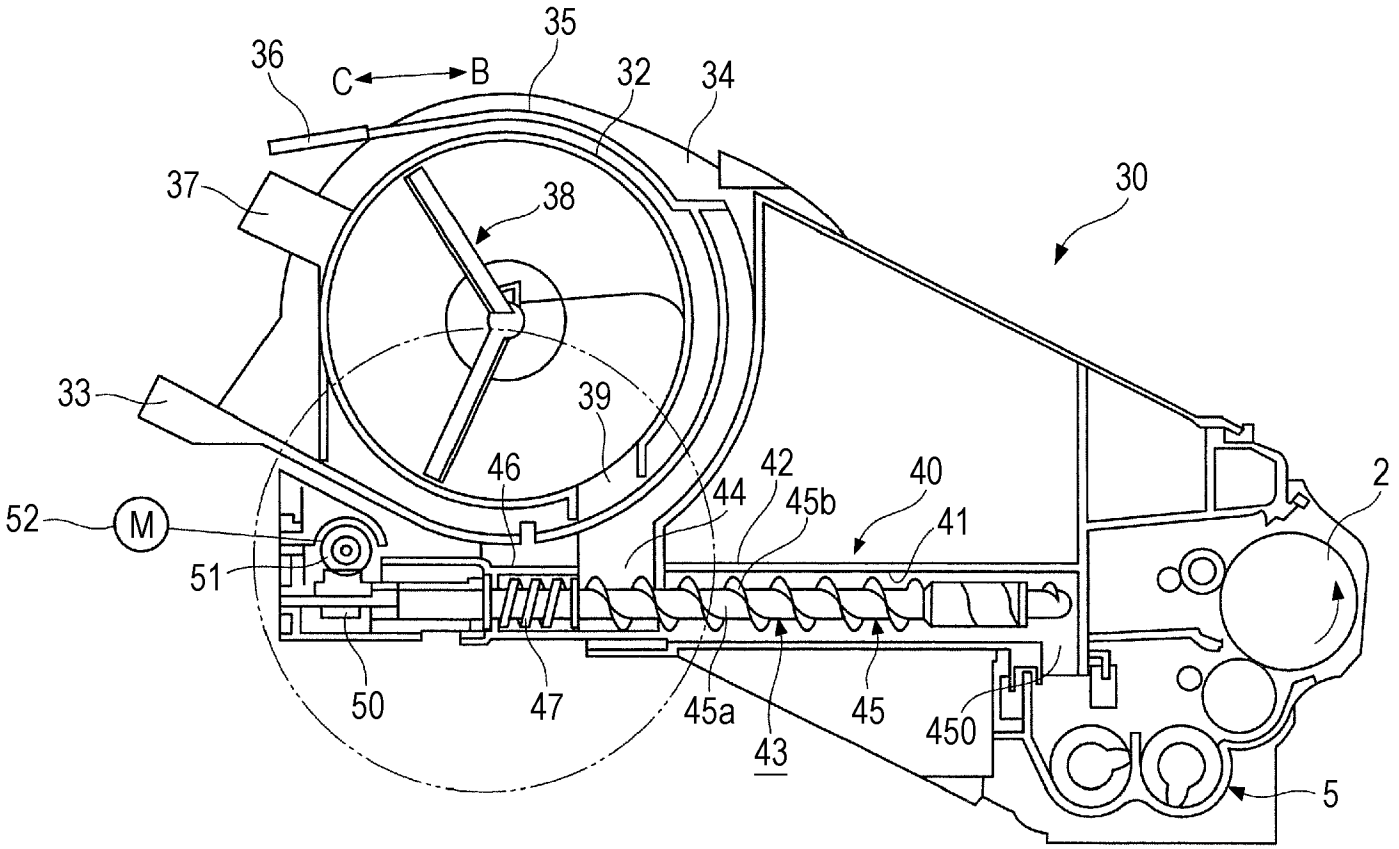
FIG. 3 is a cross-sectional view showing the configuration of the process cartridge.

As illustrated in FIG. 3, the process cartridge 30 has a fitting portion 34 in the shape of a semi-cylindrical recess to receive the toner cartridge 32, at an end opposite to the end provided with the photoconductor drum 2. The fitting portion 34 is provided with a semi-cylindrical lid body 35 that is movable along the outer circumference of the toner cartridge 32 and through which the toner cartridge 32 is fitted and removed. As illustrated in FIGS. 2 and 3, the lid body 35 is opened or closed in directions indicated by arrows B and C, with a plate-like operating portion 36 projecting at an end of the toner cartridge 32 in the longitudinal direction. More specifically, the lid body 35 is opened or closed by holding the operating portion 36 with one hand and moving the lid body 35, while holding the handle 37 provided on the toner cartridge 32 with the other hand.

As illustrated in FIG. 3, a stirring member 38 that stirs toner is provided in the toner cartridge 32 so as to be rotatable, and a rotational driving force from a driving source provided on the image forming apparatus body 1 is transmitted to the stirring member 38 when the process cartridge 30 is fitted to the image forming apparatus body 1. Furthermore, an opening 39 through which the toner stirred and transported by the stirring member 38 is discharged is provided at a lower end of a portion where the toner cartridge 32 is fitted. By moving the lid body 35 in the direction indicated by the arrow B, the fitting portion 34 to which the toner cartridge 32 is fitted is opened, making it possible to fit the toner cartridge 32 to the fitting portion 34. Thereafter, by moving the lid body 35 in the direction indicated by the arrow C, the fitting portion 34 to which the toner cartridge 32 is fitted is closed, whereby the toner cartridge 32 is fixed to a predetermined position, and a shutter member (not shown) provided on the toner cartridge 32 is moved to open the opening 39.

As illustrated in FIG. 2, a nonvolatile storage element 39 that stores the use history etc. of the process cartridge 30 is provided on the side surface of the process cartridge 30. When the process cartridge 30 is fitted to the image forming apparatus body 1, as will be described below, the nonvolatile storage element 39 is connected to a control circuit provided in the image forming apparatus body 1 such that they are able to transmit/receive data to/from each other. Furthermore, the toner cartridge 32 also has a nonvolatile storage element (not shown) that cumulatively stores the driving time of a toner supply device (described below), and, when the toner cartridge 32 is fitted to the image forming apparatus body 1, the nonvolatile storage element is connected to the control circuit provided in the image forming apparatus body 1 such that they are able to transmit/receive data to/from each other, as will be described below.

As illustrated in FIG. 3, the process cartridge 30 is integrally or separately provided with a toner supply device 40 that supplies toner from the toner cartridge 32 to the developing device 5. The toner supply device 40 includes a tubular transport-path forming member 42 that constitutes a transport path 41 through which toner is transported from the toner cartridge 32 to the developing device 5, and a transport member 43 that is provided in the transport-path forming member 42 and transports the toner to the developing device 5. The transport-path forming member 42 is cylindrical at least on the inside and extends from the lower part of the toner cartridge 32 to the upper part of the developing device 5. Furthermore, the transport-path forming member 42 is obliquely disposed such that the toner cartridge 32 side is relatively high and the developing device 5 side is relatively low, when used.

The transport-path forming member 42 has an opening 44 in the top surface, through which the toner from the toner cartridge 32 is introduced, and an opening 450 in the lower surface of the tip portion, through which the toner that has been transported therethrough is supplied to the developing device 5.

The transport member 43 has a transport portion 45 that transports toner and a driving portion 47 that is provided on the upstream side of the transport portion 45, in a toner-transporting direction, and drives a shutter member 46 to open or close the opening 44. The transport portion 45 includes a shaft 45*a* extending between the opening 37 in the toner cartridge 32 and the developing device 5, and a spiral blade 45*b* provided on the outer circumference of the shaft 45*a*. The shaft 45*a* has a small-diameter portion having a relatively small diameter and a large-diameter portion having a relatively large diameter along its axis. These small-diameter portion and large-diameter portion provided on the shaft 45*a* help improve the toner-transporting efficiency, because the toner is transported while being radially moved due to the difference in outside diameter of the shaft 45*a*.

Figure 4A:
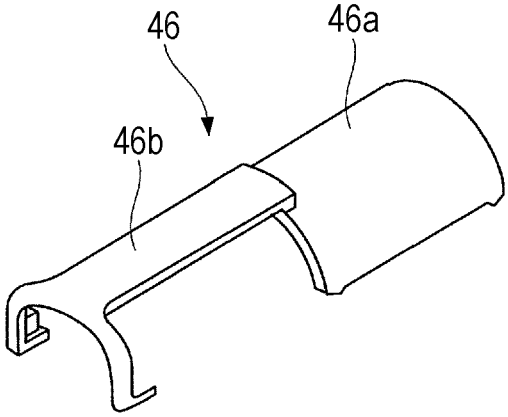
FIG. 4A is a first perspective view showing a shutter member.
Figure 4B:
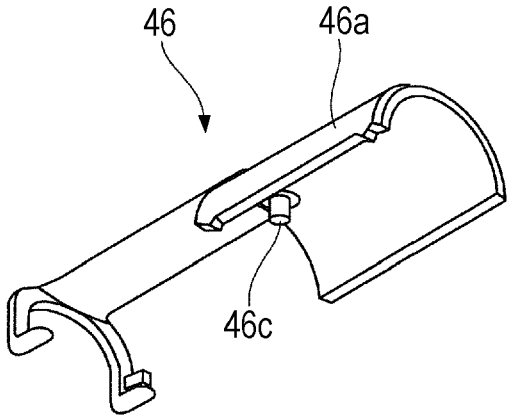
FIG. 4B is a second perspective view showing the shutter member.

The toner transport device 40 includes the shutter member 46 to open or close the opening 44. As illustrated in FIGS. 4A and 4B, the shutter member 46 includes a semi-cylindrical closing portion 46*a*, a guide member 46*b* that is provided at the tip of the closing portion 46*a* to guide the shutter member 46, and a projecting portion 46*c* projecting downward from the back surface of the tip of the closing portion 46*a* to move the shutter member 46.

Before the transport member 43 is rotated for the first time, that is, when the image forming apparatus or the process cartridge 30 is new, the shutter member 46 is located at a closed position where the opening 44 is closed. When the transport member 43 is rotated for the first time, the shutter member 46 is moved by the transport member 43 to an open position where the opening 44 is open. Thus, toner does not exist in the transport-path forming member 42 of the toner supply device 40 before the image forming apparatus is used, and leakage of toner from a joint of the toner supply device 40 is suppressed.

Figure 5:
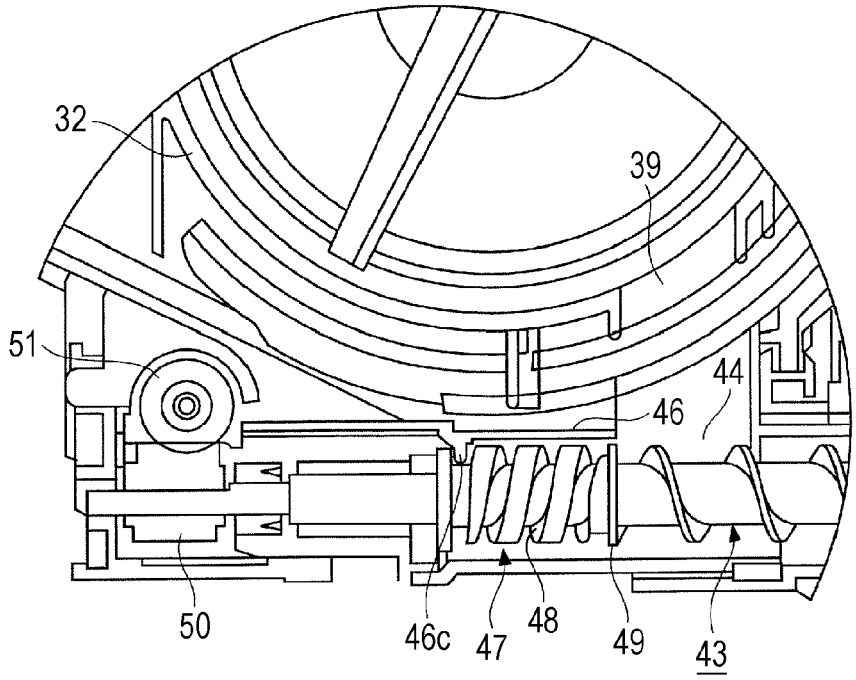
FIG. 5 is a cross-sectional view showing the configuration of the relevant part of a toner supply device.
Figure 6A:
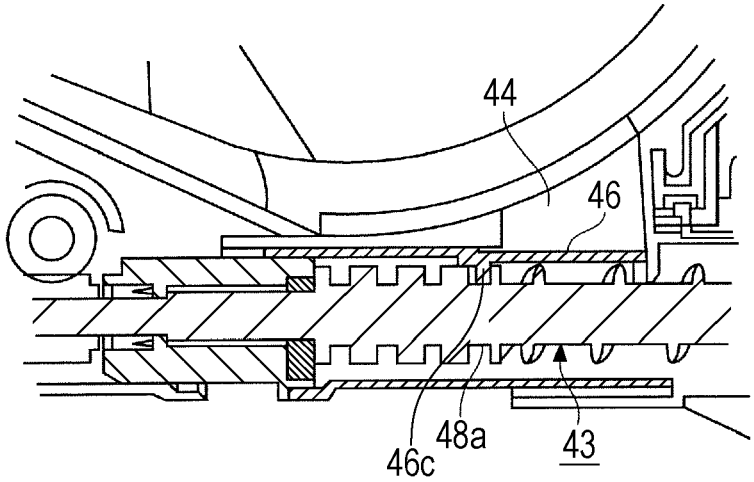
FIGS. 6A and 6B are cross-sectional views showing the operation of the toner supply device.

The driving portion 47 for driving the transport member 43 moves the shutter member 46, which closes the opening 44 in an initial state, in a direction in which the opening 44 is opened. The driving portion 47 includes a groove 48 in the shape of a spiral that turns in the direction opposite to that of the blade 45*b* of the transport portion 45. As illustrated in FIG. 5, the groove 48 extends from a movement-start portion 48*a* to a stop portion 48*b*. As illustrated in FIG. 6A, the shutter member 46 closes the opening 44 at the movement-start portion 48*a* of the groove 48. As the transport member 43 rotates, the projecting portion 46*c* of the shutter member 46 is moved along the groove 48 to the stop position, opening the opening 44. The stop portion 48*b* of the groove 48 is formed in a circular shape along the circumferential direction. The projecting portion 46*c* of the shutter member 46 fitted into the groove 48 is located at a circular portion provided at the stop portion 48*b* of the groove 48 to maintain a state in which the shutter member 46 opens the opening 44, while the transport member 43 is rotated. Furthermore, a circular portion 49 is provided at a boundary between the transport portion 46 and the driving portion 47 for driving the transport member 43 to prevent toner from entering.

Figure 6B:
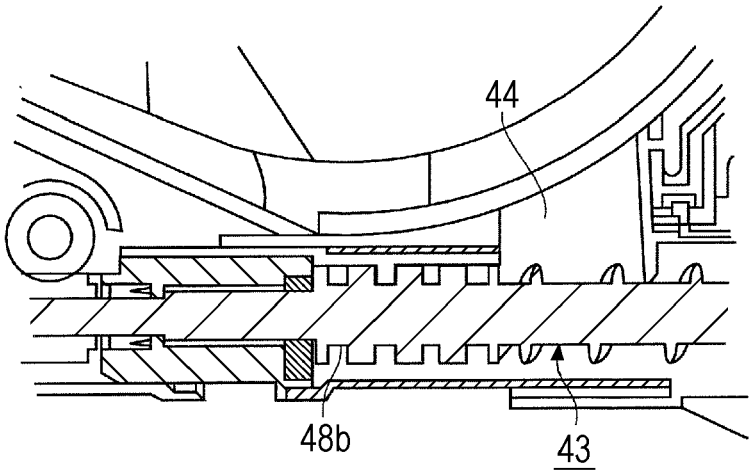

As illustrated in FIG. 3, a gear 50 is attached to a shaft provided at the base end of the transport member 42 to rotate the transport member 43. A gear 51 is meshed with the gear 50 to transmit a driving force in an intersecting direction. The gear 51 is connected to a driving gear of a driving motor 52 via gears (not shown), and, by rotating the driving motor 52, the transport member 43 is rotated, the shutter member 46 is moved to the open position, as illustrated in FIG. 6B, and the supply of toner to the developing device 5 is started.

Figure 7:
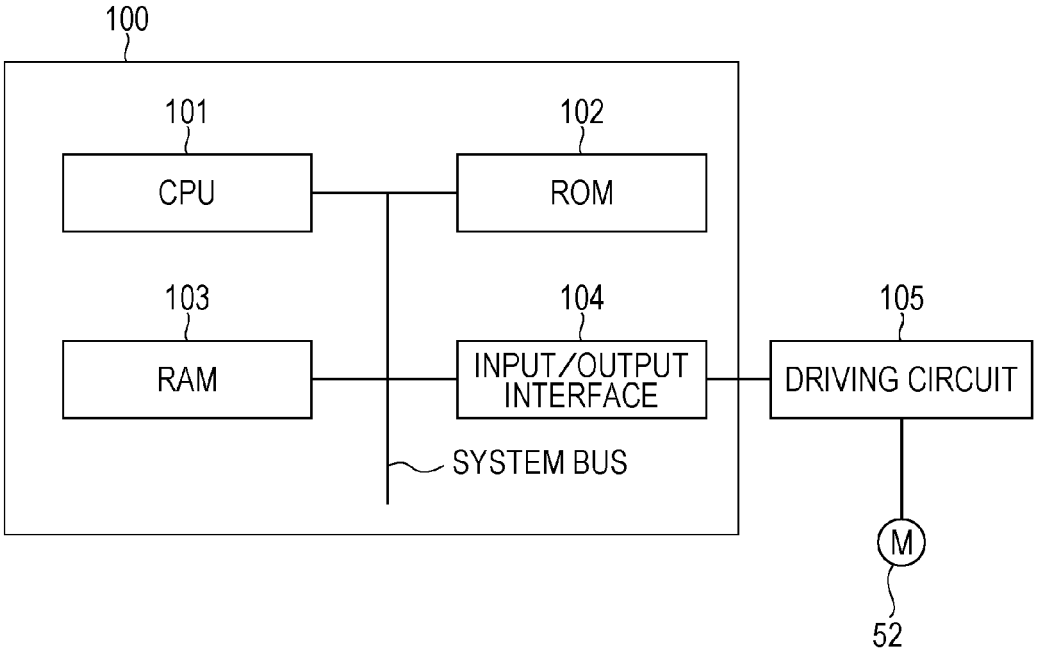
FIG. 7 is a block diagram of a control circuit.

FIG. 7 is a block diagram of a control circuit 100 of the image forming apparatus.

In FIG. 7, a central processing unit (CPU) 101 serves as a control unit that controls operation of the image forming apparatus. The CPU 101 reads out parameters etc. stored in a random-access memory (RAM) 103, which serves as a storage unit, on the basis of a program stored in a read-only memory (ROM) 102, which serves as a storage unit, and controls the operation of the image forming apparatus.

The parameters etc. stored in the RAM 103 and the nonvolatile memory 39 provided on the process cartridge 30 or the toner cartridge 32 are preliminarily set when, for example, the image forming apparatus is shipped from the factory. However, the setting of the parameters may be changed if needed, for example, when the image forming apparatus is shipped from the factory, sometime after the image forming apparatus is shipped from the factory and before it is delivered to a user, or sometime after the image forming apparatus is delivered to a user and before the user installs it to a use location. Change of the setting of the parameters stored in the RAM 103 and the nonvolatile memory 39 is of course performed while the power of the image forming apparatus is turned on.

An input/output interface 104 controls input/output of signals between the control circuit 100 and an external device. The input/output interface 104 outputs, for example, a driving signal for the driving motor 52 to drive the toner transport device 40 via a driving circuit 105. Furthermore, the input/output interface 104 transmits/receives data to/from the nonvolatile storage element 39 provided on the process cartridge 30.

With the thus-configured image forming apparatus according to this exemplary embodiment, it is possible to avoid toner leakage due to vibration occurring during transportation, in the following way.

As illustrated in FIG. 1, at the time when the image forming apparatus is shipped from the factory, the process cartridge 30 is already fitted to the image forming apparatus, and the toner cartridge 32 is already fitted to the process cartridge 30. At this time, the opening 44 in the toner supply device 40 is closed by the shutter member 46, as illustrated in FIG. 6A. Therefore, toner leakage from a joint in the toner supply device 40 due to vibration occurring during transportation is suppressed.

The setting of the image forming apparatus may be changed by the manufacturer and/or the user sometime between the time when the image forming apparatus is shipped from the factory and the time when a user installs it to a use location, i.e., a place where the image forming apparatus is used. The change of setting is performed by turning on the image forming apparatus and rewriting data stored in the nonvolatile storage element. At this time, in existing image forming apparatuses, a start-up operation is automatically started upon turning on the power, the toner supply device 40 is driven, and toner is supplied into the transport path 41. As a result, if the image forming apparatus is transported or moved after the change of setting, toner may leak from a joint in the toner supply device 40.

In this case, the image forming apparatus according to this exemplary embodiment operates as follows.

Figure 8:
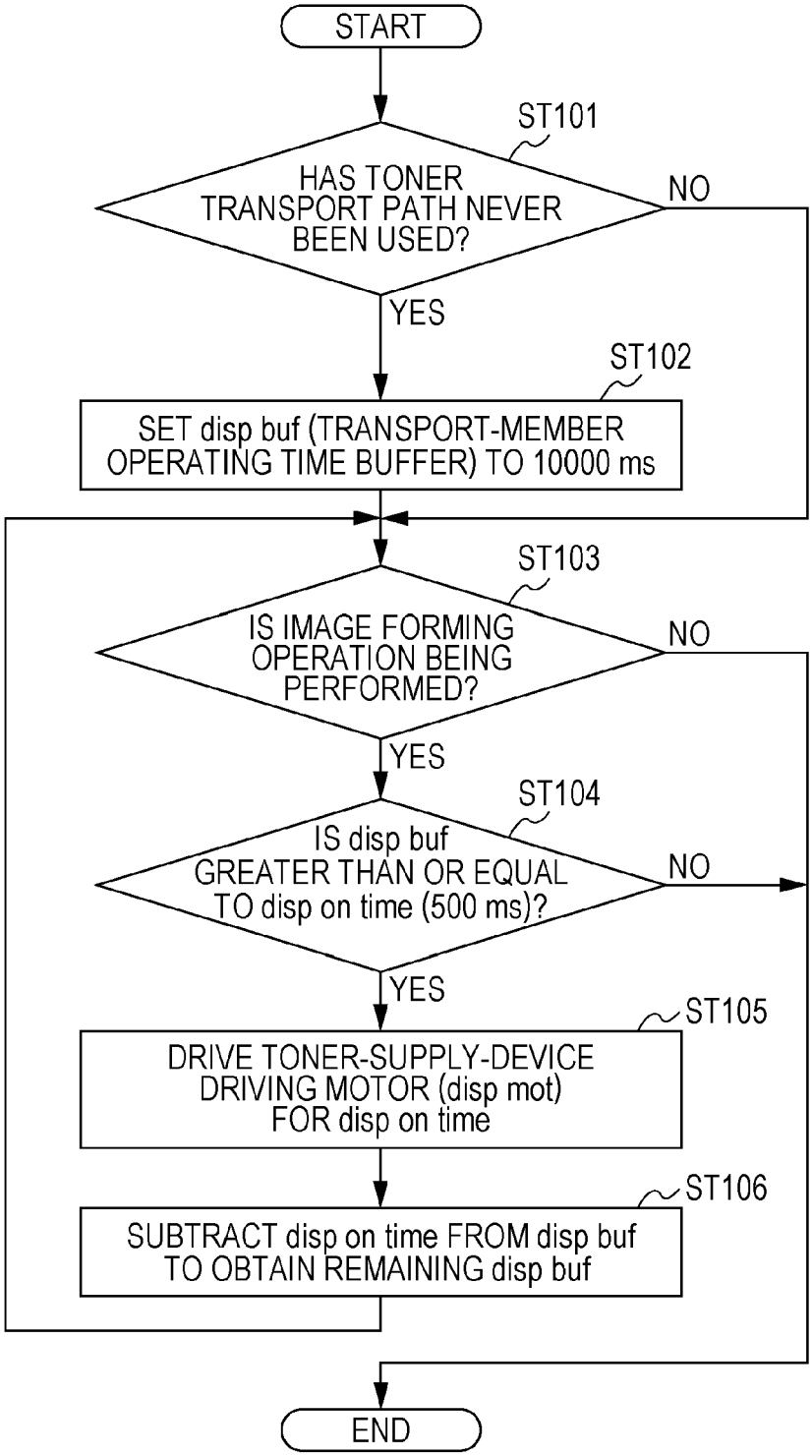
FIG. 8 is a flowchart showing the operation of the image forming apparatus according to the first exemplary embodiment of the invention.

As illustrated in FIG. 8, the CPU 101 determines whether or not the toner transport path 41 of the toner supply device 40 has never been used (step ST101). Whether or not the toner transport path 41 has never been used is determined by determining whether or not the image forming apparatus is new (has never been used) or by determining whether or not the process cartridge 30 that includes the toner transport device 40 is new. Whether or not the image forming apparatus or the process cartridge is new is determined according to the information stored in the RAM 103 and the nonvolatile storage element 39 provided on the process cartridge 30 of the image forming apparatus. When the count value indicating the number of sheets printed, which is stored in the RAM 103 of the image forming apparatus, is zero, or when the value indicating the driving time of the toner supply device 40, which is stored in the nonvolatile storage element 39 of the process cartridge 30, is zero, the image forming apparatus or the process cartridge 30 is new.

When the CPU 101 determines that the toner transport path 41 has never been used (step ST101), the CPU 101 sets an operating-time set value (disp buf) of the transport member 43 to, for example, 10000 ms (step ST102). In this exemplary embodiment, the toner transport path 41 is filled with 2000 mg of toner (developer), and the transport member 63 transports the toner at a rate of 200 mg/s. Thus, the time needed to fill an empty toner transport path 41 with toner is 2000/200=10(s). Hence, in this exemplary embodiment, the operating-time set value (disp buf) of the transport member 43 is set to 10000 ms.

Next, the CPU 101 determines whether or not the image forming apparatus is performing an image forming operation (step ST103). Whether or not the image forming apparatus is performing an image forming operation is determined by determining whether or not a print start signal for starting a printing operation has been inputted from a personal computer (not shown). When the image forming apparatus is a copier having an image reading device, whether or not the image forming apparatus is performing an image forming operation is determined by determining whether or not a copy button has been pressed and a copy start signal has been outputted. When the image forming apparatus has a facsimile function, whether or not the image forming apparatus is performing an image forming operation is determined by determining whether or not a signal to be printed has been received.

When the CPU 101 determines that the toner transport path 41 has already been used (step ST101), the CPU 101 immediately determines whether or not the image forming apparatus is performing an image forming operation.

When the CPU 101 determines that the image forming operation is not being performed, an operation to fill toner into the toner transport path of the toner supply device transport member is immediately terminated.

When the CPU 101 determines that the image forming operation is being performed, the CPU 101 determines whether or not the operating-time set value (disp buf) of the transport member 43 is greater than or equal to a toner transporting time (disp on time) (step ST104). Herein, the toner transporting time (disp on time), which is a time needed to perform one supplying operation when toner is intermittently supplied from the toner cartridge 32 to the developing device 5, is set to, for example, 500 ms. Note that the toner transporting time (disp on time) is not limited to 500 ms and may of course be shorter or longer than 500 ms.

When the CPU 101 determines that the operating-time set value (disp buf) of the transport member 43 is greater than or equal to the toner transporting time (disp on time), the CPU 101 drives the driving motor 52 for driving the toner supply device 40 for 500 ms, which is equal to the toner transporting time (disp on time) (step ST105). When the CPU 101 determines that the operating-time set value (disp buf) of the transport member 43 is less than the toner transporting time (disp on time), the processing is terminated.

Next, the CPU 101 subtracts the toner transporting time (disp on time) from the operating-time set value (disp buf) of the transport member 43 (step ST106) to obtain the remaining operating-time set value (disp buf) of the transport member 43, and then, the flow returns to step ST103.

When the image forming apparatus is performing an image forming operation, the driving motor 52 for driving the toner supply device 40 is intermittently driven to continue the operation to fill toner into the transport path 41, until the operating-time set value (disp buf) of the transport member 43 becomes less than the toner transporting time (disp on time).

As has been described above, in this exemplary embodiment, even if it is determined that the toner transport path 41 has never been used when the image forming apparatus is turned on, the toner filling operation is not performed until an image forming operation is started. Therefore, even if the image forming apparatus is turned on to change the setting thereof after it is shipped from the factory and before delivered to a user, toner is not filled into the transport path 43, and hence, leakage of toner is avoided.

Furthermore, unlike existing image forming apparatuses, a start-up operation is not performed immediately after an image forming apparatus is installed and turned on. Thus, it is possible to start a printing operation without making a user wait for the completion of the start-up operation.

Second Exemplary Embodiment

Figure 9:
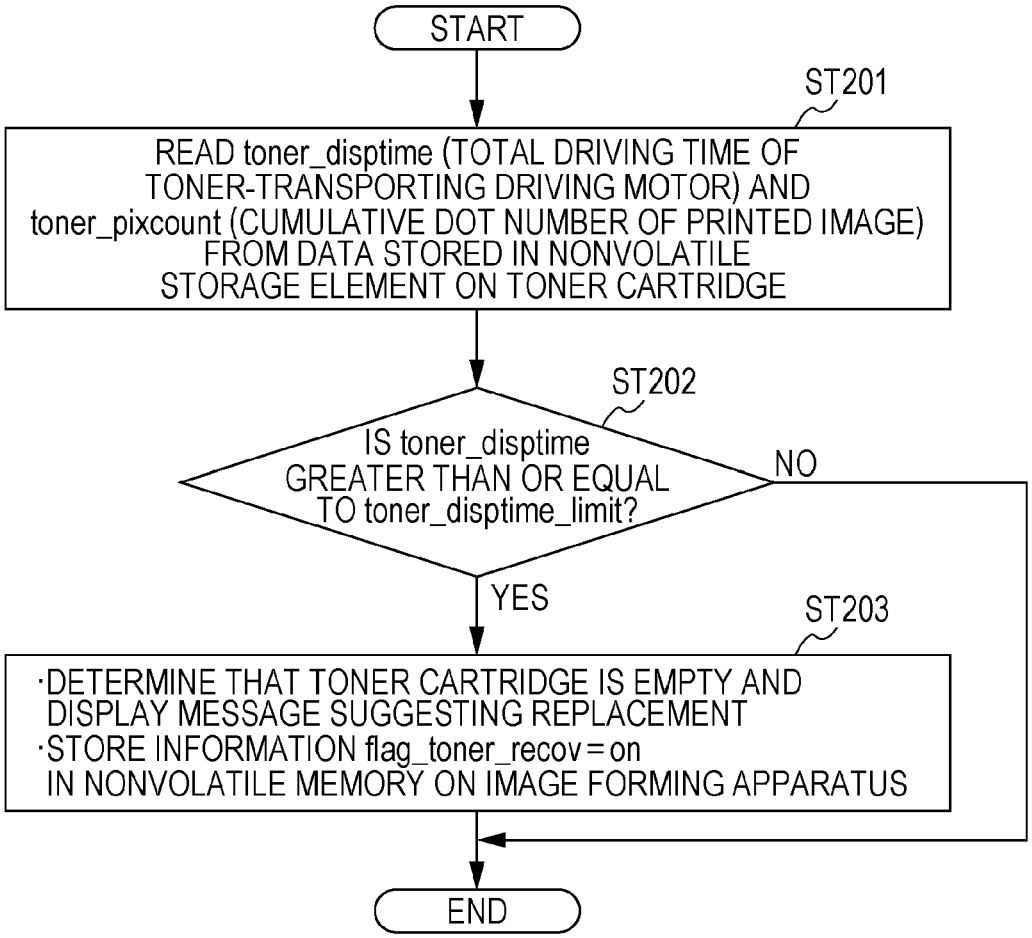
FIG. 9 is a flowchart showing the operation of an image forming apparatus according to a second exemplary embodiment of the invention.
Figure 10:
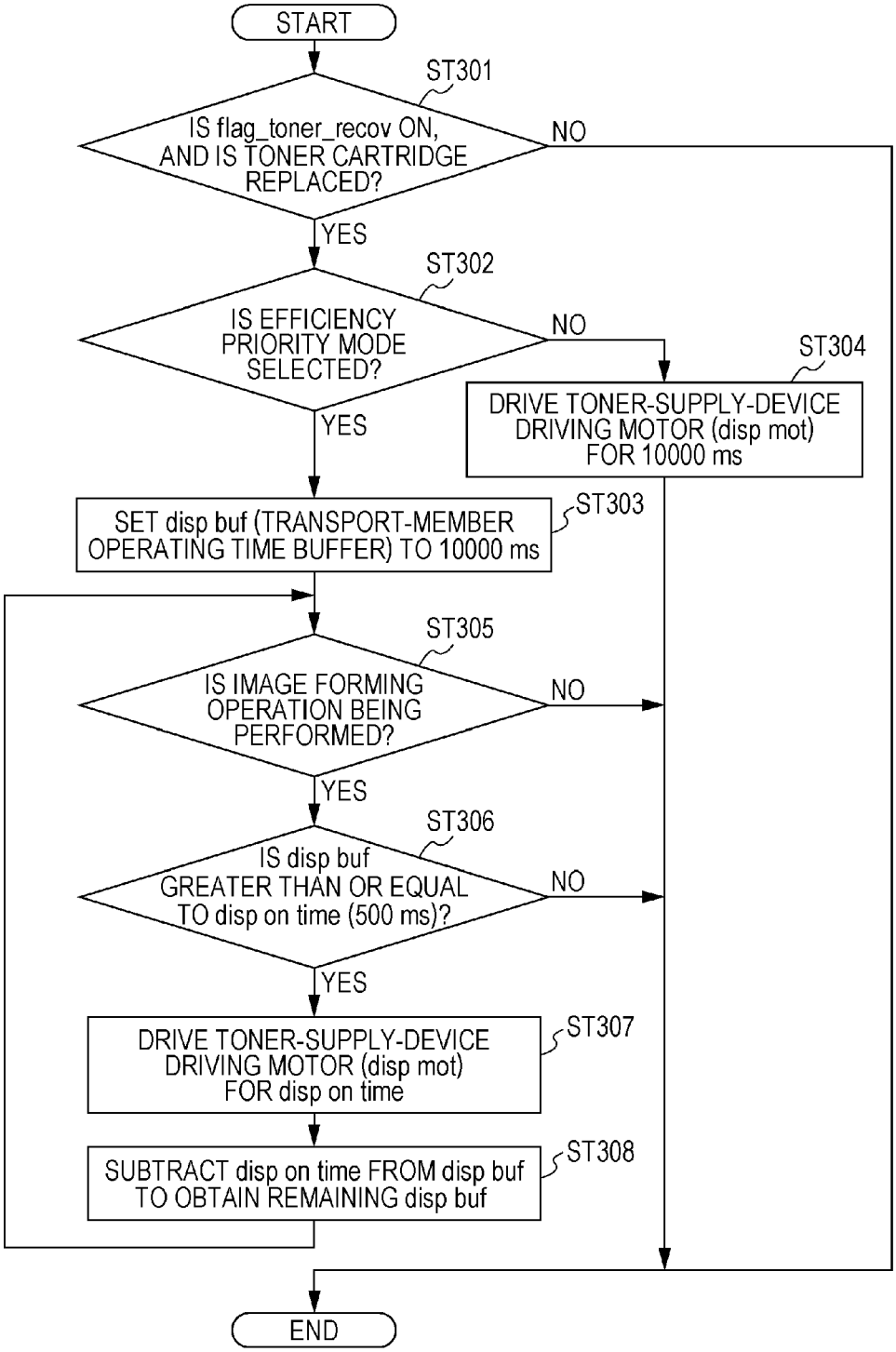
FIG. 10 is a flowchart showing the operation of an image forming apparatus according to the second exemplary embodiment of the invention.

FIGS. 9 and 10 are flowcharts showing a second exemplary embodiment of the invention. In the following description, the same components as those in the first exemplary embodiment will be denoted by the same reference numeral. An image forming apparatus according to this exemplary embodiment further includes a developer presence/absence determination device that determines whether or not the developer container is empty, and a replacement determination device that determines whether or not the developer container has been replaced. When the developer presence/absence determination device determines that the developer container is empty, and the replacement determination device determines that the developer container has been replaced, the transport member is driven after an image-forming operation is started.

More specifically, as illustrated in FIGS. 9 and 10, in this second exemplary embodiment, the CPU 101 performs the following operation.

The CPU 101 reads the total driving time (toner_disptime) of the driving motor 52 for transporting toner and the cumulative dot number (toner_pixcount) of printed images from the data stored in the nonvolatile storage element of the toner cartridge 32 (step ST201).

Next, the CPU 101 determines whether or not the total driving time (toner_disptime) of the driving motor 52 for transporting toner is greater than or equal to a determination value (toner_disptime_limit) that is used to determine whether or not the toner cartridge 32 is empty (step ST202). If it is determined that the total driving time (toner_disptime) of the driving motor 52 for transporting toner is greater than or equal to the determination value (toner_disptime_limit) used to determine whether or not the toner cartridge 32 is empty, it is determined that the toner cartridge 32 is empty, and a message suggesting replacement of the toner cartridge 32 to a user is indicated on a user interface (step ST203). The determination value is set such that the toner in the transport path 41 is also used up.

At the same time, the CPU 101 stores information to the effect that flag_toner_recov, suggesting replacement of the toner cartridge 32 to a user, is on in the RAM 103, which is a nonvolatile memory provided on the device body 1 (step ST203), and the process is terminated.

Then, as illustrated in FIG. 10, the CPU 101 determines whether or not the flag_toner_recov, suggesting replacement of the toner cartridge 32 to a user, is on and whether or not the toner cartridge 32 has been replaced (step ST301). Whether or not the toner cartridge 32 has been replaced is determined by, for example, reading the serial number on the toner cartridge 32 and determining whether or not the serial number is different from that on the toner cartridge 32 before replacement. If it is determined that the toner cartridge 32 has not been replaced, the process is immediately terminated.

When the CPU 101 determines that the flag_toner_recov, suggesting replacement of the toner cartridge 32 to a user, is on and that the toner cartridge 32 has been replaced, the CPU 101 determines whether or not an efficiency priority mode is selected (step ST302). If it is determined that the efficiency priority mode is selected, the operating-time set value (disp buf) of the transport member 43 is set to, for example, 10000 ms (step ST303).

Furthermore, when the efficiency priority mode is not selected, after the driving motor 52 for driving the toner supply device 40 is continuously driven for just 10000 ms, the process is terminated.

Then, similarly to the first exemplary embodiment, the CPU 101 determines whether or not the image forming apparatus is performing an image forming operation (step ST305). When the CPU 101 determines that the image forming operation is not being performed, the operation to fill toner into the toner transport path of the transport member of the toner supply device is immediately terminated.

When the CPU 101 determines that the image forming operation is being performed, the CPU 101 determines whether or not the operating-time set value (disp buf) of the transport member 43 is greater than or equal to the toner transporting time (disp on time) (step ST306).

When the CPU 101 determines that the operating-time set value (disp buf) of the transport member 43 is greater than or equal to the toner transporting time (disp on time), the CPU 101 drives the driving motor 52 for driving the toner supply device 40 for 500 ms, which is equal to the toner transporting time (disp on time) (step ST307). When the operating-time set value (disp buf) of the transport member 43 is less than the toner transporting time (disp on time), the process is terminated.

Then, the CPU 101 subtracts the toner transporting time (disp on time) from the operating-time set value (disp buf) of the transport member 43 (step ST308) to obtain the remaining operating-time set value of the toner transport member, and the process returns to step ST305.

If the image forming apparatus is performing an image forming operation, the driving motor 52 for driving the toner supply device 40 is driven to continue the operation to fill toner into the transport path 41 until the operating-time set value (disp buf) of the toner transport member becomes less than the toner transporting time (disp on time).

As has been described above, in this second exemplary embodiment, a user may choose whether or not the efficiency priority mode is selected, and when the efficiency priority mode is selected, similarly to the first exemplary embodiment, the operation to fill toner into the transport path 41 by the toner supply device 40 is performed every predetermined period of time, on condition that the image forming operation is being performed.

Therefore, unlike existing image forming apparatuses, a start-up operation is not performed immediately after the toner cartridge 32 is replaced and the image forming apparatus is turned on. Thus, it is possible to start a printing operation without making a user wait for the completion of the start-up operation and to improve the efficiency.

When the toner cartridge 32 is replaced, and the efficiency priority mode is not selected, the operation to completely fill toner into the toner transport path is performed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image bearing member that bears an electrostatic latent image;

a developer container containing developer;

a developing unit that develops the electrostatic latent image on the image bearing member with the developer;

a tubular transport-path forming member that forms a transport path through which the developer is transported from the developer container to the developing unit;

a transport member that is disposed inside the transport-path forming member and transports the developer from the developer container to the developing unit; and a control unit that performs control such that, when the transport-path forming member is used for the first time, an operation to fill the developer into the transport-path forming member is performed by driving the transport member after the image forming operation is started, wherein the controller is configured such that the developer is not supplied into the transport-path forming member until the image forming apparatus starts an image forming operation, after the image forming apparatus is turned on to be used for the first time and the developer is supplied in response to the start of image forming operation.

2. The image forming apparatus according to claim 1, wherein the transport-path forming member has an opening at a portion on the upstream side with respect to a developer-transporting direction, the opening being initially closed by a shutter and being opened in conjunction with the operation to fill the developer.

3. The image forming apparatus according to claim 2, wherein the operation to fill the developer into the transport-path forming member is performed by driving the transport member every predetermined period of time.

4. The image forming apparatus according to claim 1, wherein the operation to fill the developer into the transport-path forming member is performed by driving the transport member every predetermined period of time.

5. The image forming apparatus according to claim 1, further comprising a toner container removably attached to the developing unit.

6. The image forming apparatus according to claim 5, further comprising a shutter member that prohibits developer from moving from the toner container to the transport path.

7. The image forming apparatus according to claim 6, wherein the shutter member is moveable engaged with the transport member such that the shutter member moves to permit developer movement between the toner container and the transport path in response to a rotation of the transport member.

* * * * *